United States Patent [19]

Kittelsen et al.

[11] Patent Number: 4,977,905

[45] Date of Patent: Dec. 18, 1990

[54] PROTECTIVE MOUTHGUARD ASSEMBLY

[76] Inventors: Jon D. Kittelsen, 1221 W. County Rd. B, Roseville, Minn. 55113; Timothy J. Thomas, 4347 45th Ave. South, Minneapolis, Minn. 55406

[21] Appl. No.: 429,841

[22] Filed: Oct. 31, 1989

[51] Int. Cl.[5] ..... A61F 5/14

[52] U.S. Cl. ..... 128/861

[58] Field of Search ..... 128/859, 860, 861, 862

[56] References Cited

U.S. PATENT DOCUMENTS

| | | | |
|---|---|---|---|
| 2,694,397 | 11/1954 | Herms | 128/861 |
| 2,847,003 | 8/1958 | Helmer | 128/861 |
| 3,058,462 | 10/1962 | Greenblum | 128/861 |
| 3,082,765 | 3/1963 | Helmer | 128/861 |
| 3,124,129 | 3/1964 | Grossberg | 128/862 |
| 3,203,417 | 8/1965 | Helmer | 128/861 |
| 3,312,218 | 4/1967 | Jacobs | 128/862 |
| 3,407,809 | 10/1968 | Ross | 128/861 |
| 3,448,738 | 6/1969 | Berghash | 128/861 |
| 3,485,242 | 12/1969 | Greenberg | 128/862 |
| 3,768,465 | 10/1973 | Helmer | 128/862 |
| 4,114,614 | 9/1978 | Kesling | 128/861 |
| 4,791,941 | 12/1988 | Schaefer | 128/861 |

*Primary Examiner*—Robert A. Hafer
*Assistant Examiner*—Michael Brown
*Attorney, Agent, or Firm*—Dorsey & Whitney

[57] ABSTRACT

A tethered, protective mouthguard assembly for attachment to a helmet or headgear including a mouthpiece portion, a connecting tab integrally formed with the mouthpiece and provided with a tether opening therein, a separate tether constructed of a cord-like material and an attachment element connected with the tether for selectively and easily attaching the tether to and detaching the tether from the connecting tab.

23 Claims, 3 Drawing Sheets

PROTECTIVE MOUTHGUARD ASSEMBLY

BACKGROUND OF THE INVENTION

1. Field Of The Invention

The present invention relates generally to a protective mouthguard for use in athletics and more particularly, to an improved protective mouthguard assembly which can be selectively tethered from a helmet for easy attachment and removal. The present invention also includes a protective case.

2. Summary Of The Prior Art

A number of mouthguards currently exist in the art for protecting the teeth and for reducing the chance of shock, concussions and other injuries as a result of high impact collisions and blows during athletic competition. In general, mouthguards existing in the art can be placed into two broad categories: tethered and untethered. Untethered mouthguards are commonly fabricated by dentists to fit the exact contour of the user's teeth or are manufactured in a single configuration, with the user trimming the mouthguard to the correct size with a scissors and then molding the mouthguard to his or her teeth after softening the mouthguard in boiling water. An example of this latter mouthguard is illustrated in U.S. Pat. No. 3,411,501 issued to Greenberg.

In athletic activities which utilize a helmet or other protective headgear, and in particular in high impact sports such as football and hockey, it is desirable for the mouthpiece to be tethered to the helmet or to the face mask. The principal reasons are twofold. First, having the mouthguard tethered to the helmet or face mask eliminates the chance that the mouthguard will be lost or misplaced and secondly, and perhaps most important, a number of instances have arisen where the user inadvertently swallows the mouthguard as a result of impact or otherwise during activity. This can result in the user choking on the mouthpiece, thus causing severe injury or death.

The tethered mouthpieces that currently exist in the art are generally of one piece construction comprising a moldable mouthpiece and an integrally formed tether strap constructed of the same material as the mouthpiece and extending from the mouthpiece for connection to a helmet or the like. U.S. Pat. Nos. 4,044,762 and 3,312,218, both issued to Jacobs, are illustrative of such a tethered mouthguard. Another tethered mouthguard in which the tether is removable from the mouthguard is shown in the above mentioned U.S. Pat. No. 3,411,501. In this patent, the tether strap is constructed of the same material as the mouthguard.

There are several limitations relating to presently existing tethered mouthguards. First, because the tether straps are constructed of the same material as the mouthguard, the straps are generally quite wide in order to prevent the same from inadvertently breaking. As a result, the straps are stiff and cumbersome and have a relatively limited flexibility. Therefore, it is often difficult for players to comfortably position the mouthpiece in the mouth, particularly for younger players, without noticing or being affected by the general stiffness and inflexibility of the tether strap. These tether straps also tend to further stiffen and curl over time.

Secondly, for this same reason, the tethered mouthguards in the prior art are, for the most part, limited to connection to the face mask of a helmet in a position in which the tether strap extends directly in front of the user's mouth. The general stiffness and inflexibility of the prior art tether straps makes it difficult to connect the tether strap off center or to a side portion of the headgear in the event there is no face mask.

Thirdly, because the tether strap is constructed of the same material as the mouthguard, which is generally stiff, it is often difficult, particularly for younger players, to connect the mouthguard to the helmet since it involves forcing an enlarged portion of one end of the tether strap through a small opening along the length of the tether strap.

Fourthly, the tether straps of the prior art, for the most part, are difficult to remove and will virtually never be removed. If the helmet is removed from the user as a result of a high impact collision or the like, this results in the mouthpiece being violently pulled from the user's mouth, thus also giving rise to serious injury.

Accordingly, there is a need in the art for an improved protective mouthguard for use in athletic competition, and in particular, an improved tethered mouthguard which is safer, is provided with a quick release and which results in improved comfort and flexibility for the user.

SUMMARY OF THE INVENTION

In contrast to the prior art, the present invention relates to a tethered mouthguard for use in athletic competition which provides much greater comfort and flexibility of use and connection to the helmet and which is also easy to attach and detach from the headgear. In a further embodiment, the mouthguard can include a flexible loop to be worn around the user's neck.

More specifically, the mouthguard assembly of the present invention includes a mouthpiece portion which is adapted for insertion into the user's mouth and protective engagement with the user's teeth. A relatively short connecting tab is integrally formed with a forward end of the mouthpiece and includes a tether attachment opening for connection with a tether. A separate tether constructed of a highly flexible cord-like material is adapted for connection with the helmet or helmet face mask or around the neck and includes attachment means for selectively and easily attaching the tether to and detaching the tether from the attachment opening in the connecting tab.

In the preferred embodiment, the separate tether is constructed of a material different than the material from which the mouthpiece is constructed. Preferably, the tether is constructed of a relatively limp and flexible cord-like material which is highly flexible and which can easily extend from the connecting tab at right angles with little, if any, resulting pressure or stress on the mouthpiece. Further, the tether of the preferred embodiment is formed in the shape of a closed loop with its ends extending from a tether bead adapted for insertion into the attachment opening. The tether opening of the preferred embodiment is an elongated opening having a width less than the diametrical dimension of the tether bead and a length greater than the diametrical dimension of the tether bead.

A further aspect of the present invention includes a storage case having an opening therein to allow the connecting tab to extend outside of the case while enclosing the mouthpiece portion. The storage case can be used either with the mouthpiece connected to the helmet or with it free of the helmet.

Accordingly, it is an object of the present invention to provide an improved protective mouthguard assembly having means for tethering the same to a helmet or headgear or worn around the neck.

Another object of the present invention is to provide an improved tethered protective mouthguard assembly which is provided with a separate, detachable tether constructed of a material different than the material from which the mouthpiece is constructed.

A further object of the present invention is to provide an improved tethered protective mouthguard assembly in which the tether is constructed of a relatively limp and flexible cord-like material to permit flexibility in connection to the helmet or around the neck and increased comfort to the user.

Another object of the present invention is to provide an improved tethered mouthguard assembly in which the tether can be easily attached and detached from the mouthpiece.

A still further object of the present invention is to provide an improved tethered mouthguard assembly in which, for safety reasons, the mouthpiece will break away when the helmet to which the tether is connected is thrown from the user's head or twisted by impact or the like.

Another object of the present invention is to provide a tethered mouthpiece having an improved storage case.

These and other objects of the present invention will become apparent with reference to the drawings and the description of the preferred embodiment.

DESCRIPTION OF THE PREFERRED EMBODIMENT

Figure 1:
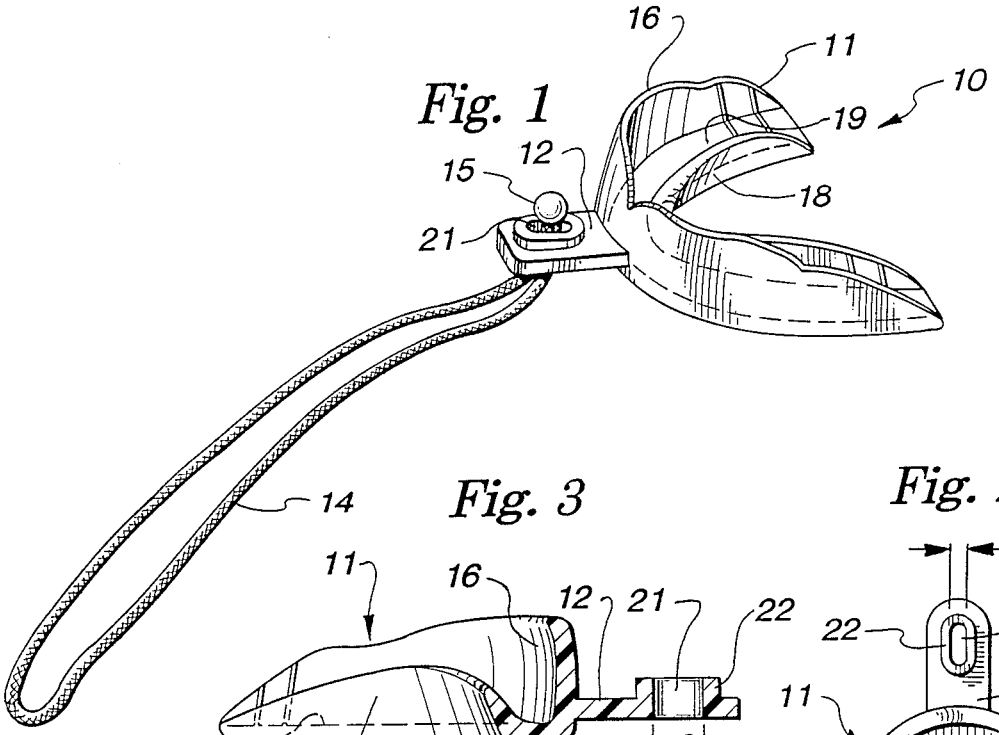
FIG. 1 is a perspective view of the mouthguard assembly of the present invention showing the tether attached to the mouthpiece.

With reference to the drawings, and in particular to FIG. 1, the protective mouthguard assembly 10 of the present invention includes a mouthpiece portion 11 adapted for insertion into the user's mouth and for protective engagement with the user's teeth, a connecting tab 12 integrally formed with a forward end of the mouthpiece 11 and a separate tether 14 constructed of a cord-like material and having an attachment means in the form of the tether bead 15 for selective attachment to and detachment from the connecting tab 12.

Figure 3:
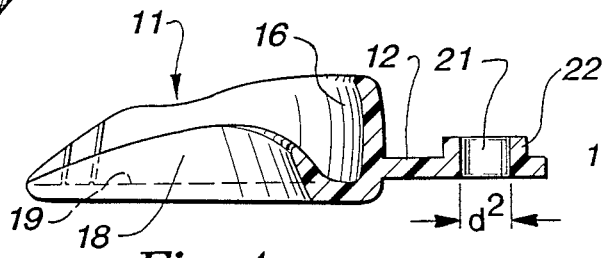
FIG. 3 is a sectional view of the mouthpiece portion of the mouthguard assembly of the present invention as viewed along the section line 3—3 of FIG. 2.
Figure 2:
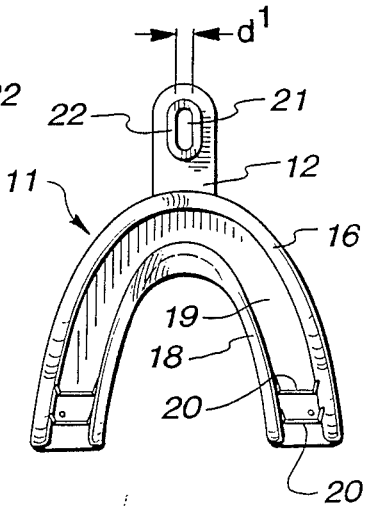
FIG. 2 is a top elevational view of the mouthpiece portion of the mouthguard assembly of the present invention.

As illustrated generally in FIG. 1 and with more specific reference to FIGS. 2 and 3, the mouthpiece portion 11 is a conventional mouthpiece member constructed of a thermal plastic material. Although the mouthpiece can be constructed of a variety of thermal plastic type materials, the material contemplated for the preferred embodiment is an ethylene vinyl acetate material such as DuPont Elvax No. 250 or Union Carbide DQDA No. 3269. The mouthpiece portion 11 is provided with a forward or outer protective flange 16 and an inner or rearward protective flange 18 defining a protective web or channel 19 between them.

The rearwardmost end of the mouthpiece portion 11 is provided with a plurality of cut lines 20. These cut lines 20 serve as guides for the user to cut or trim the mouthpiece to fit the particular user's mouth size.

The connecting tab 12 is integrally formed with a forward portion of the mouthpiece 11 and extends forwardly therefrom. The tab 12 is constructed of the same material as the mouthpiece 11 and is provided with an attachment opening 21. This opening can have a variety of shapes. In the preferred embodiment, however, the opening 21 is elongated with a width dimension $d^1$ (FIG. 2) being less than the diameter of the tether bead 15 (FIG. 1) and with a length dimension $d^2$ (FIG. 3) greater than the diameter of the tether bead 15. Both the width dimensions $d^1$ and the length dimension $d^2$ should preferably be greater than the diameter of the cord-like material from which the tether 14 is constructed. The preferred embodiment shows the tab 12 as being integral with, and of the same material as, the mouthpiece 11; however, the present invention contemplates the tab 12 constructed separately of the same or different material and secured to the mouthpiece 11 by adhesive or some other means.

The tab 12 also includes a reinforced or thicker portion 22 surrounding the attachment opening 21. This portion 22 provides the tab 12 with additional reinforcement around the opening 21 to better control the attachment and detachment of the tether 14. The tab 12 extends outwardly from the mouthpiece portion 11 for a relatively short distance which is less than the widest portion of the mouthpiece 11.

Figure 4:
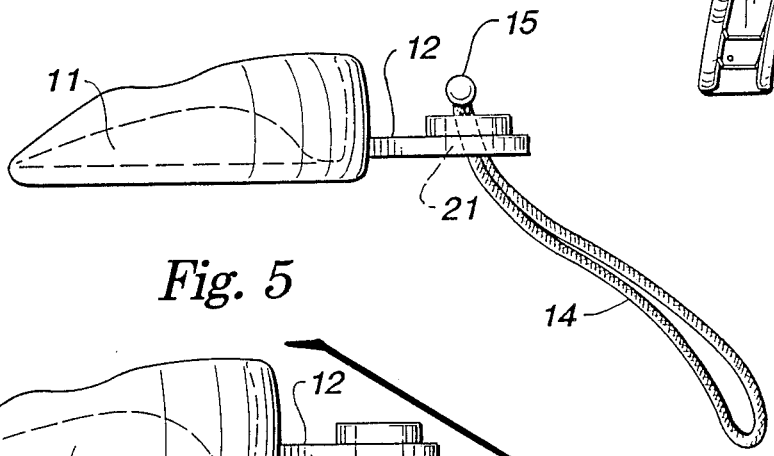
FIG. 4 is a side elevational view of the mouthguard assembly of the present invention showing the tether attached to the mouthpiece.
Figure 5:
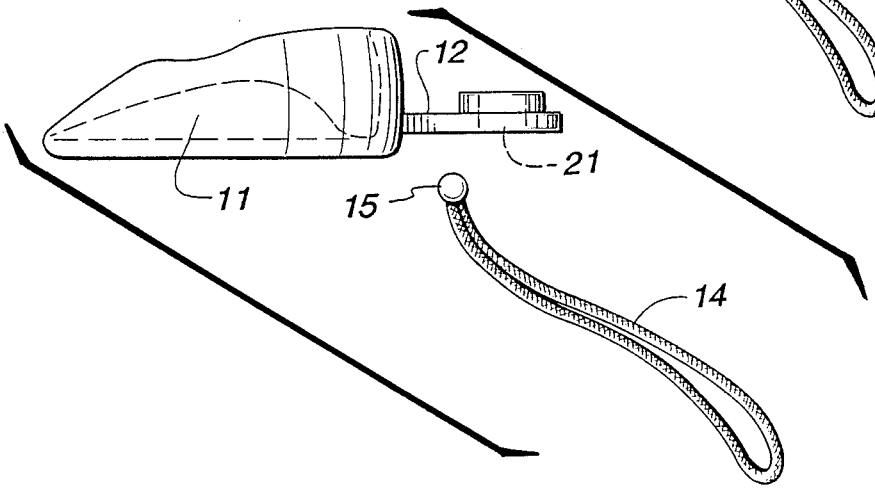
FIG. 5 is a side elevational view showing the mouthguard assembly of the present invention with the tether detached from the mouthpiece.

The tether 14 is illustrated best in FIGS. 1, 4 and 5. Although it is contemplated that the separate tether 15 could comprise a single piece of cord-like material having one end connected to the mouthpiece portion through the tether bead 15, and a second end connectable with the helmet, the preferred construction provides a tether 14 having a closed loop configuration as illustrated. The closed loop configuration allows the tether to be easily attached to and detached from the helmet or face guard merely by looping a portion of the tether around the face mask and inserting the mouthpiece portion 11 therethrough. If a single tether is used, the end opposite the bead 15 could be connected with the helmet, etc. by a snap, Velcro, or the like.

Figure 11:
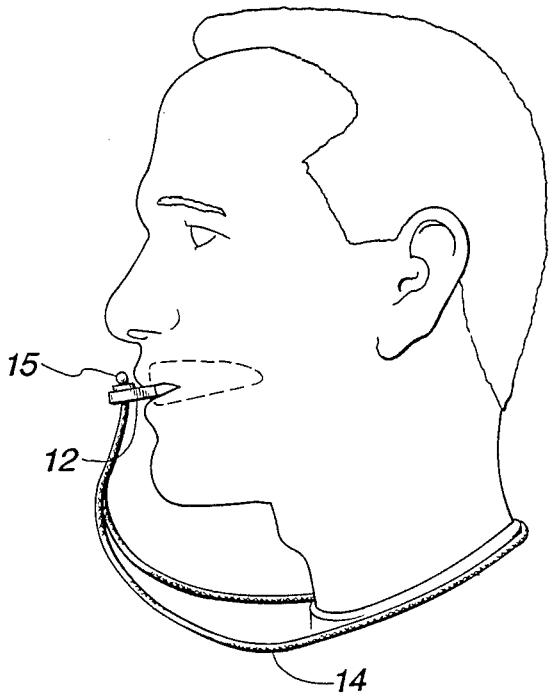
FIG. 11 is a side elevational view showing the mouthguard tethered around the user's neck.

The material from which the tether 14 is constructed is relatively flexible and limp in order to facilitate connection of the tether to different portions of the helmet or face guard. In the preferred embodiment, the tether is a woven or braided cord-like material constructed from a material such as Nylon. This highly flexible and limp characteristic of the tether 14 enables it to be connected to one side of the face mask with no noticeable discomfort to the user. Similarly, of course, the tether 14 can be connected immediately forward of the mouthpiece portion. In this position the highly flexible tether also provides improved comfort to the wearer when compared to prior art designs. An extended tether can also be looped around the user's neck as shown in FIG. 11, when no headgear or helmet is used such as when playing soccer. The tether 14, of course, can also be constructed of other materials having similar properties such as braided or woven cotton, etc.

The tether bead is connected to an end portion of the tether 14 and is constructed of a relatively hard material such as molded polyethylene. Various other materials, however, can also be utilized. The material from which the tether bead 15 is constructed, however, should preferably be much harder and much less deformable than the material from which the connecting tab 12 is constructed.

Figure 6:
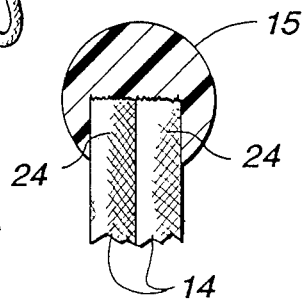
FIG. 6 is an enlarged view showing the connection of the tether end portions to the tether bead.
Figure 7:
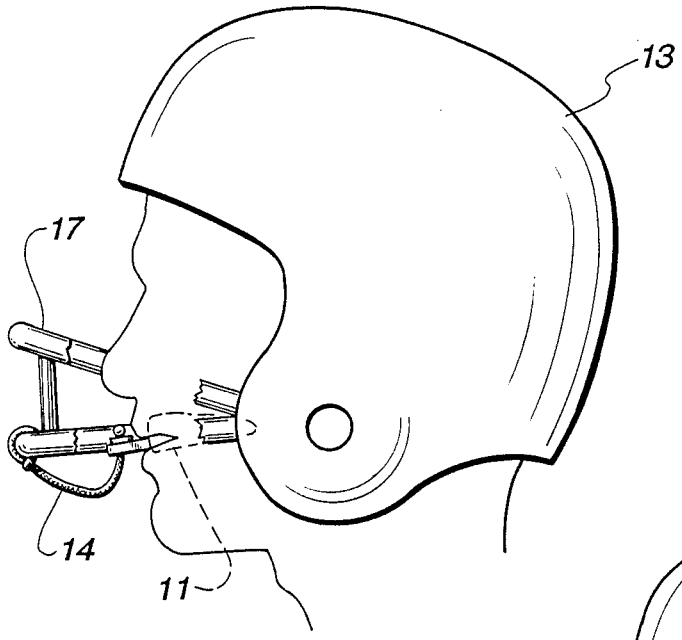
FIG. 7 is a side elevational view showing the mouthguard assembly of the present invention attached to a football helmet face guard.
Figure 8:
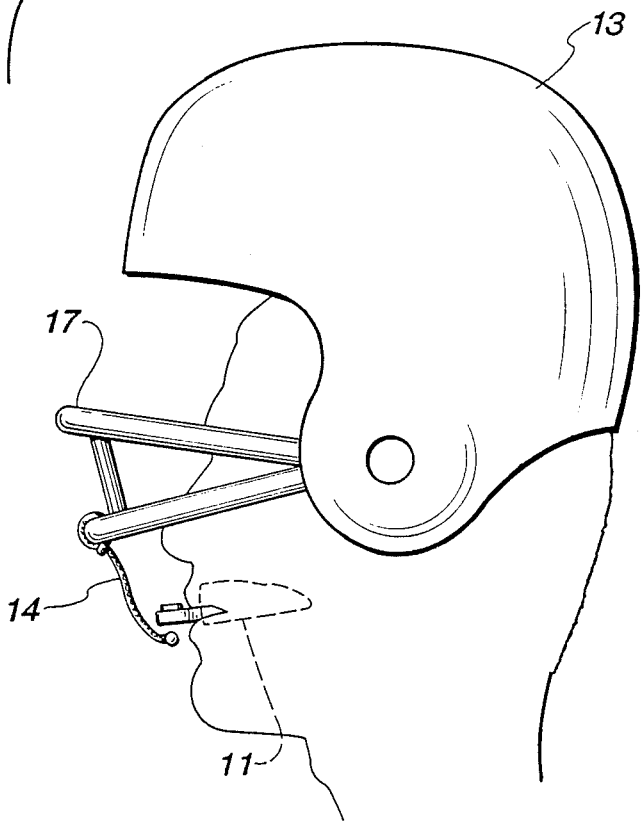
FIG. 8 is a view similar to FIG. 7 in which the tether has been detached from the mouthpiece as a result of impact removing the helmet.

In the preferred embodiment, the tether bead 15 is attached to the tether 14 in a manner which facilitates easy attachment to and detachment from the connecting tab 12 through the attachment opening 21. FIG. 6 illustrates the preferred method of connecting the tether 14 to the tether bead 15. As shown in FIG. 6, the two end portions 24 of the tether 14 are inserted into a opening in the tether bead 15 and extend outwardly therefrom such that the end portions 24 extend from the tether bead 15 in generally face-to-face registration with one another. This provides a structure which facilitates relatively easy insertion of the tether bead 15 through the opening 21 as well as facilitating relatively easy removal of the tether bead from the connecting tab 12 by pulling on the tether 14.

Although there are a variety of ways in which the tether 14 can be connected to the bead 15, the preferred embodiment contemplates the ends 24 of the tether 14 being secured to the bead 15, or to an opening within the bead 15, via an appropriate adhesive.

Figure 12:
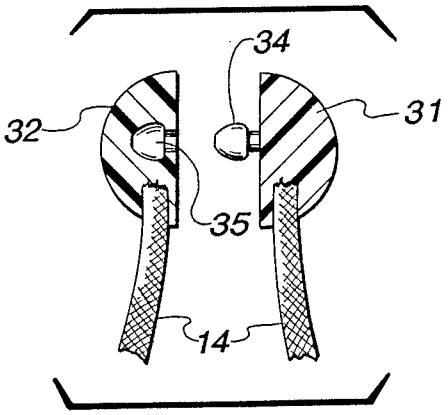
FIG. 12 is a view, partially in section, showing an alternate structure for connecting the ends of the tether to the tether bead.

To attach the tether to the tether bead in accordance with the preferred embodiment, the ends of the tether 24, 24 are placed into a mold cavity and the bead 15 is injection molded in the cavity and around the ends. An alternate mechanism for connecting the tether to the bead is illustrated in FIG. 12. Here, the ends of the tether 14 are placed into separate mold cavities, each representing one-half of the bead 15. The bead halves are then formed by injection molding. In this embodiment, the bead halves 31 and 32 are designed to snap together or to be retained together via adhesive. Each of the halves 31, 32 is provided with corresponding connection elements 34, 35, respectively for connection with one another.

A still further method of forming the bead 15 is to place the ends of the tether 14 together and burn the ends so that the synthetic material from which the tether is made melts and form a hardened bead upon cooling. A still further method is to dip the ends of the tether into liquified bead material and allow the material to harden or cure around the ends.

The bead 15 can be a variety of sizes and can have a variety of shapes. It must, however, have at least one diametrical dimension which is greater than one of the dimensions of the opening 21. Preferably the tether bead 15 is spherically shaped and has a diameter which is greater than the width dimension $d^1$ of the opening 21 and less than the length dimension $d^2$ of the opening 21. More specifically, the diameter of the tether bead of the preferred embodiment is approximately twice the width dimension $d^1$ of the opening 21 while the length dimension $d^2$ of the opening 21 is approximately one and one-half times greater than the diameter of the bead 15.

Figure 9:
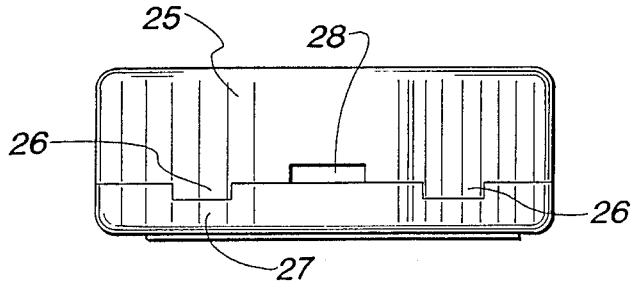
FIG. 9 is a front elevational view of the storage case.
Figure 10:
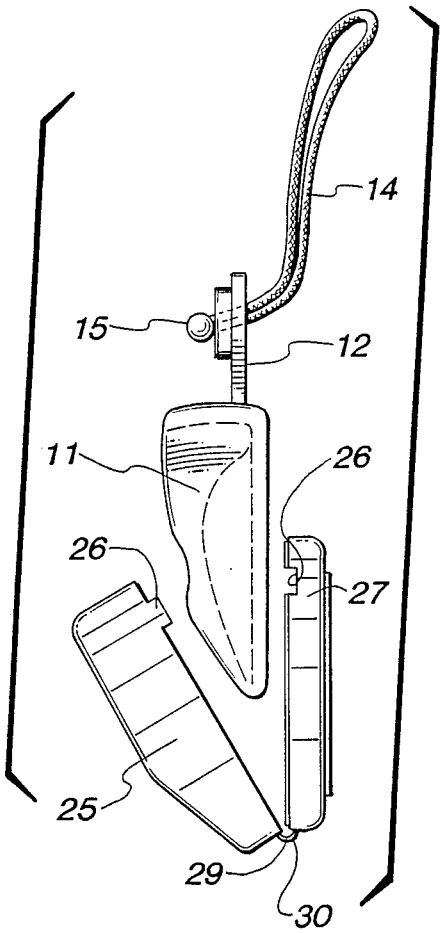
FIG. 10 is an elevational view showing the storage case in an open position and the mouthpiece being inserted therein.

Reference is next made to FIGS. 9 and 10 illustrating a storage case for the mouthguard of the present invention. The storage case includes a top section 25 and a bottom section 27 which are joined together by a hinge 30. A pair of cooperating snap members 26 are provided for selectively closing and opening the case. An opening 28 is provided in the forward end of the case to permit the tab 12 to extend out of the case while the mouthpiece 11 is enclosed with the case. This permits the case to be used while the mouthguard is connected to the helmet or if it is removed. The case keeps the mouthguard clean and assists in keeping the mouthguard from being lost or misplaced.

Having described the structure of the mouthguard assembly of the preferred embodiment, the use thereof will be generally described as follows. First, upon fitting the mouthpiece, the mouthpiece portion 11 is trimmed to fit the particular user's mouth and is formed to the user's teeth and gum configuration, etc. by following appropriate instructions known in the art. The tether 14 and tether bead 15 is first connected to the tab 12 by inserting the bead 15 or the opposite end of the tether 14 through the opening 21. The bead 15 can be inserted so that its final position is on top of the tab 12 as shown in FIG. 4, or reversed. The mouthguard is then attached to the face guard of the helmet or directly to the helmet itself by looping the tether 14 around a portion of the face mask and inserting the mouthpiece portion 11 therethrough. If the mouthguard assembly is desired to be removed from the helmet or face mask, this process is reversed. If, during use, the helmet is removed from the user as a result of an impact or the like, the tether will break free of the mouthpiece portion, thus leaving the mouthpiece in the user's mouth and minimizing the chance of possible damage as a result of the mouthpiece being pulled out of the mouth as a result of the helmet being thrown or pulled from the user.

Although the description of the preferred embodiment has been quite specific, it is contemplated that various modifications could be made without deviating from the spirit thereof. Accordingly, it is intended that the present invention be dictated by the appended claims rather than by the description of the preferred embodiment.

What is claimed is:

1. A protective, tethered mouthguard assembly comprising:

a mouthpiece portion for insertion into the user's mouth and protective engagement with the user's teeth;

a connecting tab connected directly to said mouthpiece portion and having a first tether attachment means therein; and a breakaway tether separate from said mouthpiece portion and connecting tab, said tether having a second tether attachment means that is separate from said mouthpiece and attachable to said first tether attachment means for selectively attaching said tether to, and detaching said tether from, said connecting tab and for facilitating the breakaway feature of said tether.

2. The mouthguard assembly of claim 1 wherein said first tether attachment means includes an attachment opening and said second tether attachment means includes a tether bead.

3. The mouthguard assembly of claim 2 wherein said tether bead is generally spherical.

4. The mouthguard assembly of claim 2 wherein said attachment opening is smaller than said tether bead, said attachment opening being large enough to permit easy manual insertion of said tether bead and small enough to provide the desired force needed to remove said tether bead from said attachment opening.

5. The mouthguard assembly of claim 2 wherein said attachment opening is generally elongated and has a width dimension less than the largest diametrical dimension of said tether bead and a length dimension greater than the largest diametrical dimension of said tether bead.

6. The mouthguard assembly of claim 5 wherein said tether bead is generally spherical.

7. The mouthguard assembly of claim 6 wherein said tether comprises a closed loop construction having a pair of end portions connected with said second tether attachment means.

8. The mouthguard assembly of claim 7 wherein each of said end portions is embedded within said tether bead such that said end portions extend from said tether bead in generally face-to-face registration with one another.

9. The mouthguard assembly of claim 8 wherein said tether is constructed of a relatively flexible limp material.

10. The mouthguard assembly of claim 9 wherein said tether is constructed of Nylon cording material.

11. The mouthguard assembly of claim 5 wherein said tether has a diametrical dimension less than the width dimension of said attachment opening.

12. The mouthguard assembly of claim 1 wherein said tether comprises a closed loop construction having a pair of end portions connected with said second tether attachment means.

13. The mouthguard assembly of claim 12 wherein said attachment means includes a tether bead.

14. The mouthguard assembly of claim 13 wherein each of said end portions is embedded within said tether bead such that said end portions extend from said tether bead in generally face-to-face registration with one another.

15. The mouthguard assembly of claim 1 wherein said tether is constructed of a relatively flexible, limp material.

16. The mouthguard assembly of claim 15 wherein said tether is constructed of a braided Nylon cording material.

17. The mouthguard assembly of claim 1 wherein said connecting tab is relatively short and extends from the forward end of said mouthpiece for a distance less than the overall width of said mouthpiece.

18. The mouthguard assembly of claim 1 including a case having an opening therein to allow said connecting tab to extend outside said case when said mouthpiece is enclosed within said case.

19. The mouthguard assembly of claim 1 wherein said connecting tab is integrally formed with said mouthpiece portion.

20. The mouthguard assembly of claim 1 wherein said mouthpiece portion has a forward facing end and a rearward facing end when inserted into the user's mouth and wherein said connecting tab extends outwardly from a central portion of said forward facing end.

21. A protective, tethered mouthguard assembly comprising:

a mouthpiece portion for insertion into the user's mouth and protective engagement with the user's teeth, said mouthpiece portion having a forward facing end and a rearward facing end when inserted into the user's mouth;

first tether attachment means connected with said forward end of said mouthpiece portion;

a tether separate from said mouthpiece portion being constructed of a relatively flexible, limp cord; and second tether attachment means connected with said tether and cooperating with said first tether attachment means for selectively attaching said tether to, and detaching said tether from, said mouthpiece portion.

22. The mouthguard of claim 21 wherein said cord is constructed of a material having properties similar to that of a braided Nylon cord.

23. The mouthguard of claim 21 wherein said cord is constructed of a generally non-elastic cord.

* * * * *